US009568015B2

(12) United States Patent
Horng

(10) Patent No.: US 9,568,015 B2
(45) Date of Patent: Feb. 14, 2017

(54) CENTRIFUGAL FAN

(71) Applicant: Sunonwealth Electric Machine Industry Co., Ltd., Kaohsiung (TW)

(72) Inventor: Alex Horng, Kaohsiung (TW)

(73) Assignee: Sunonwealth Electric Machine Industry Co., Ltd., Koahsiung (TW)

( * ) Notice: Subject to any disclaimer, the term of this patent is extended or adjusted under 35 U.S.C. 154(b) by 456 days.

(21) Appl. No.: 14/151,980

(22) Filed: Jan. 10, 2014

(65) Prior Publication Data

US 2014/0219789 A1 Aug. 7, 2014

(30) Foreign Application Priority Data

Feb. 5, 2013 (TW) ..... 102104394 A

(51) Int. Cl.

| | |
|---|---|
| ***F04D 29/30*** | (2006.01) |
| ***F04D 29/16*** | (2006.01) |
| ***F04D 29/28*** | (2006.01) |
| *F04D 25/06* | (2006.01) |

(52) U.S. Cl.

CPC ..... *F04D 29/162* (2013.01); *F04D 29/281* (2013.01); *F04D 29/30* (2013.01); *F04D 25/0653* (2013.01)

(58) Field of Classification Search

CPC ..... F04D 29/162; F04D 29/281; F04D 29/30; F04D 25/0653

USPC ..... 415/172.1, 173.6, 204, 206; 416/189, 416/190, 192, 194, 195, 196 A, 185, 186 R, 416/223 B

See application file for complete search history.

(56) References Cited

U.S. PATENT DOCUMENTS

| | | | | |
|---|---|---|---|---|
| 7,083,387 | B2 * | 8/2006 | Chen | F04D 29/325 416/189 |
| 8,562,297 | B2 | 10/2013 | Yen et al. | |
| 2005/0249604 | A1 | 11/2005 | Wu et al. | |
| 2007/0222331 | A1 * | 9/2007 | Horng | F04D 27/004 310/268 |

FOREIGN PATENT DOCUMENTS

| | | | |
|---|---|---|---|
| CN | 101328904 | A | 12/2008 |
| CN | 101818739 | A | 9/2010 |
| TW | M250230 | U | 11/2004 |
| TW | 200903233 | A | 1/2009 |

* cited by examiner

*Primary Examiner* — Christopher Verdier

(74) *Attorney, Agent, or Firm* — Alan D. Kamrath; Kamrath IP Lawfirm, P.A.

(57) ABSTRACT

A centrifugal fan includes a fan frame, a stator assembly and an impeller. The fan frame has a base plate portion, a cover plate portion and a lateral wall portion. The cover plate portion has an air inlet, and the lateral wall portion has an air outlet. The impeller includes a rotating member, a plurality of blades and a connection ring. The rotating member is coupled with the stator assembly. Each blade has a windward edge and a lateral edge. The windward edge faces the air inlet, the lateral edge faces the lateral wall portion, and the connection ring is arranged on the windward edges of the blades. The windward edge has a first coupling edge, and the connection ring has a second coupling edge. A part of the windward edge between the first coupling edge and the lateral edge extends downwards in a curved manner, forming a truncating portion.

16 Claims, 8 Drawing Sheets

CENTRIFUGAL FAN

BACKGROUND OF THE INVENTION

1. Field of the Invention

The present invention generally relates to a centrifugal fan and, more particularly, to a centrifugal fan capable of providing an improved cooling effect with reduced noise.

2. Description of the Related Art

FIG. 1 shows a conventional centrifugal fan 9 disclosed by Taiwan Patent No. M250230 entitled "A WIND-REDUCING RING STRUCTURE OF A CENTRIFUGAL FAN". Centrifugal fan 9 includes a housing 91, an impeller 92 and a wind-reducing ring 93. Housing 91 includes an air inlet 911 and an air outlet. Impeller 92 is mounted in housing 91. A plurality of blades 921 is arranged on an outer peripheral wall of impeller 92. Wind-reducing ring 93 is coupled with an edge of each blade 921 that is adjacent to air inlet 911, so that the cooling effect of fan 9 can be improved.

Wind-reducing ring 93 of fan 9 may be arranged in a location which is just outside of a radial extent of air inlet 911 under an upper wall 91*a* of housing 91, as shown in FIG. 1. Alternatively, wind-reducing ring 93 may also be arranged in a location which is within the radial extent of air inlet 911 and is adjacent to upper wall 91*a* of housing 91, as shown in FIG. 2. However, in the arrangement shown in FIG. 2, upper edge 921*a* of each blade 921 is too close to upper wall 91*a* of housing 91. As such, upper edge 921*a* of blade 921 is liable to make contact with upper wall 91*a* of housing 91 during the rotation of impeller 92. In addition, due to the small distance between upper edge 921*a* of blade 921 and upper wall 91*a* of housing 91, wind noise easily results when impeller 92 draws air into fan 9 via air inlet 911.

SUMMARY OF THE INVENTION

It is therefore the objective of this invention to overcome the above problems of conventional centrifugal fans, where the rotating impeller is too close to the upper wall of the housing, by providing a centrifugal fan capable of preventing the impeller from making contact with the upper wall of the housing.

It is another objective of this invention to provide a centrifugal fan capable reducing the wind noise generated during the rotation of the impeller.

In a preferred embodiment, a centrifugal fan comprises a fan frame, a stator assembly and an impeller. The fan frame has a base plate portion, a cover plate portion, and a lateral wall portion arranged between the base plate portion and the cover plate portion. The cover plate portion has an inner edge forming an air inlet, and the lateral wall portion has an air outlet. The stator assembly is mounted in the fan frame. The impeller is mounted in the fan frame and comprises a rotating member, a plurality of blades and a connection ring. The rotating member is rotatably coupled with the stator assembly. The plurality of blades is arranged on an outer periphery of the rotating member. Each blade has a windward edge and a lateral edge. The windward edge faces the air inlet, the lateral edge faces the lateral wall portion, and the connection ring is arranged on the windward edges of the plurality of blades. The windward edge of each blade has a first coupling edge, and the connection ring has a second coupling edge. A part of the windward edge between the first coupling edge and the lateral edge extends downwards in a curved manner, thereby forming a truncating portion between the connection ring and the lateral edge.

In a preferred form shown, the air inlet has a first radial extent from a center of the impeller, the connection ring has a second radial extent from the center of the impeller, and the second radial extent is smaller than the first radial extent.

In the preferred form shown, a part of the outer periphery of the rotating member that is coupled with the windward edge of each blade is defined as a connecting edge. The connecting edges are spaced from the inner edge of the cover plate portion by a radial range. An axial reference plane is arranged at a center of the radial range. The connection ring is located between the axial reference plane and the inner edge of the cover plate portion.

In the preferred form shown, the connection ring has a top edge and a bottom edge, and the first and second coupling edges are located on the top edge.

In the preferred form shown, the connection ring has a top edge and a bottom edge, and the first and second coupling edges are located on the bottom edge.

In the preferred form shown, the connection ring has a top edge and a bottom edge, and the first and second coupling edges are located between the top edge and the bottom edge.

In the preferred form shown, the windward edge of each blade has an arcuate section connected to the lateral edge.

In the preferred form shown, the arcuate section extends downwards in an arcuate manner from the first coupling edge to the lateral edge, thereby forming the truncating portion.

In the preferred form shown, the windward edge of each blade has an inclined section connected to the lateral edge.

In the preferred form shown, the inclined section extends downwards in an inclined manner from the first coupling edge to the lateral edge, thereby forming the truncating portion.

In the preferred form shown, the windward edge of each blade has a bending section connected to the lateral edge.

In the preferred form shown, the bending section extends downwards in an inclined manner after the first coupling edge and then extends radially to the lateral edge, thereby forming the truncating portion.

In the preferred form shown, the plurality of blades is coupled with an inner periphery of the connection ring.

In the preferred form shown, the plurality of blades extends upon and around the connection ring in a manner that the plurality of blades is coupled with inner and outer peripheries of the connection ring.

In the preferred form shown, the lateral edge of each blade has an end connected to the truncating portion, and the end is relatively distant to a bottom face of the cover plate portion among a part of the blade between the first coupling edge and the end.

In the preferred form shown, the connection ring has cross sections in the form of a round shape or an oval shape.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
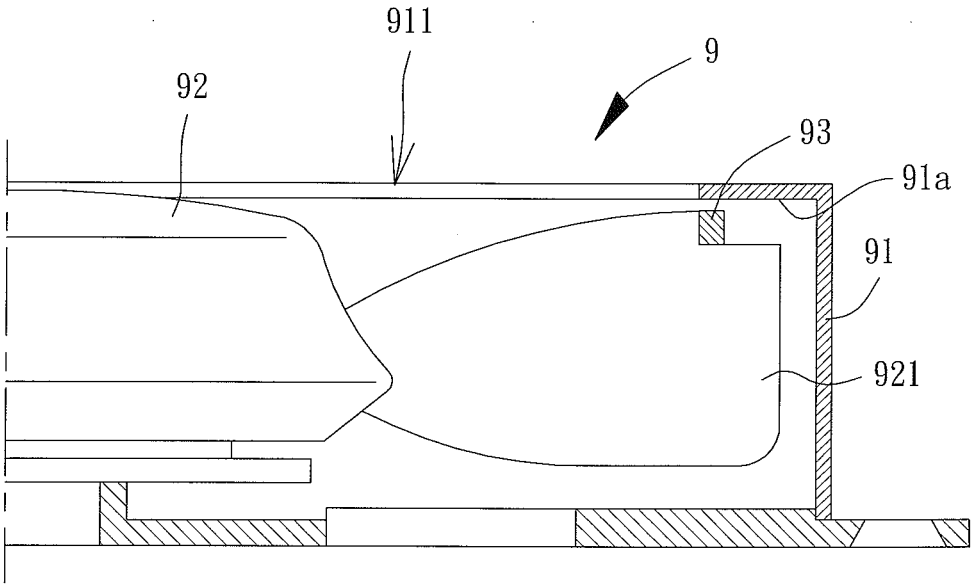
FIG. 1 PRIOR ART
FIG. 1 is a cross-sectional view of a conventional centrifugal fan.
Figure 2:
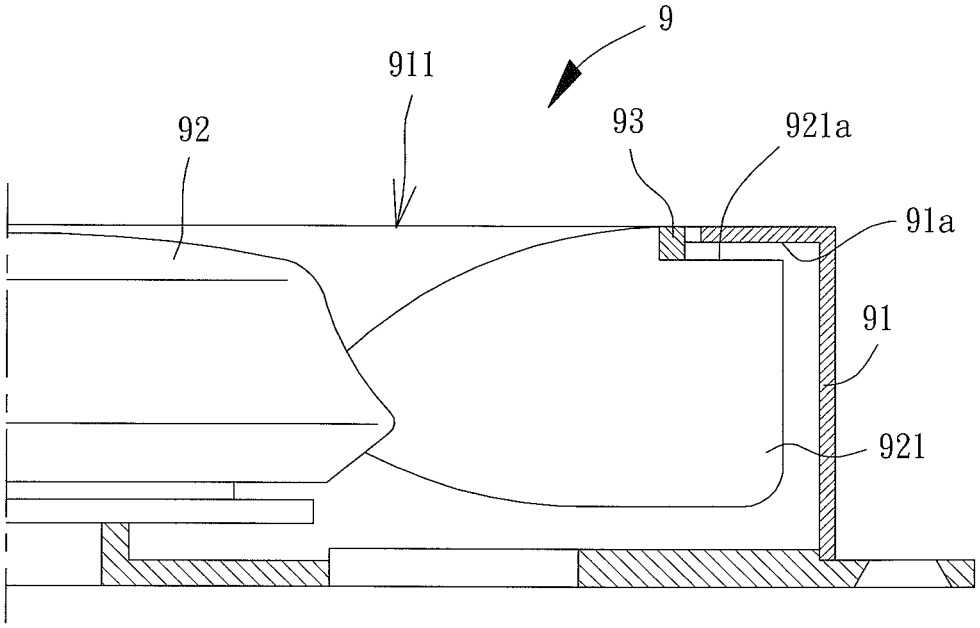
FIG. 2 PRIOR ART
FIG. 2 is a cross-sectional view of another conventional centrifugal fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 3:
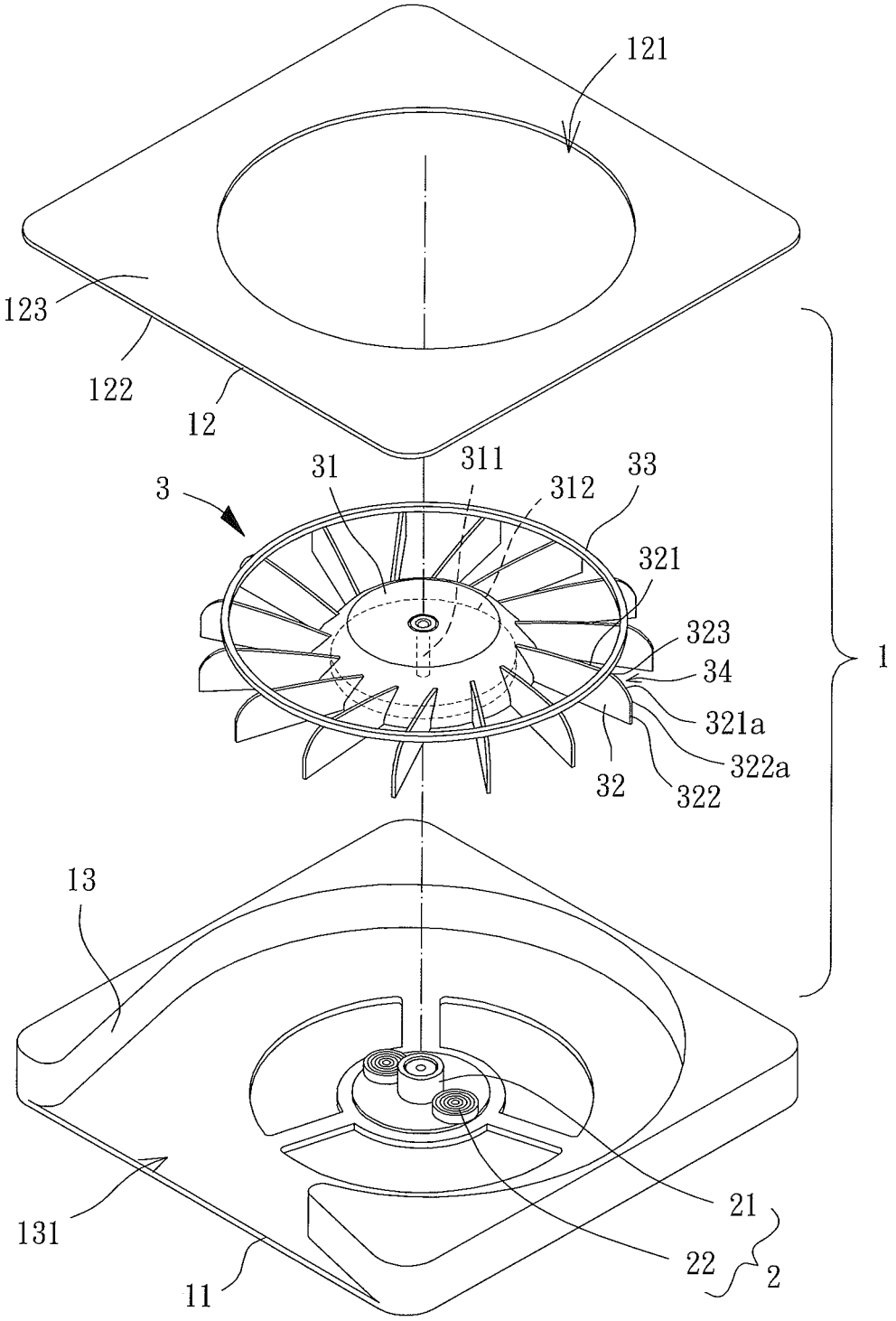
FIG. 3 is an exploded view of a centrifugal fan according to a first embodiment of the invention.

FIG. 3 discloses a centrifugal fan including a fan frame 1, a stator assembly 2 and an impeller 3 according to a preferred embodiment of the invention. Air can be guided into and out of fan frame 1. Stator assembly 2 is disposed in fan frame 1. Impeller 3 is rotatably coupled with stator assembly 2, so that stator assembly 2 is able to drive impeller 3 to rotate.

Fan frame 1 is of any hollow frame structure so that air can flow into the frame structure in an axial direction and flow out of the frame structure in a radial direction. The frame structure may have various geometric shapes, such as a polygonal shape, a round shape, an oval shape, etc. In this embodiment, fan frame 1 has a rectangular shape.

Fan frame 1 includes a base plate portion 11 and a cover plate portion 12 spaced from the base plate portion 11 at a distance. The distance allows a lateral wall portion 13 to be arranged between base plate portion 11 and cover plate portion 12. Base plate portion 11, cover plate portion 12 and lateral wall portion 13 can be coupled with each other in any manner without limitations. In this embodiment, lateral wall portion 13 is integrally formed on an outer periphery of base plate portion 11 by injection molding. Cover plate portion 12 is in the form of a cover plate that can be affixed to or detached from lateral wall portion 13.

Figure 4A:
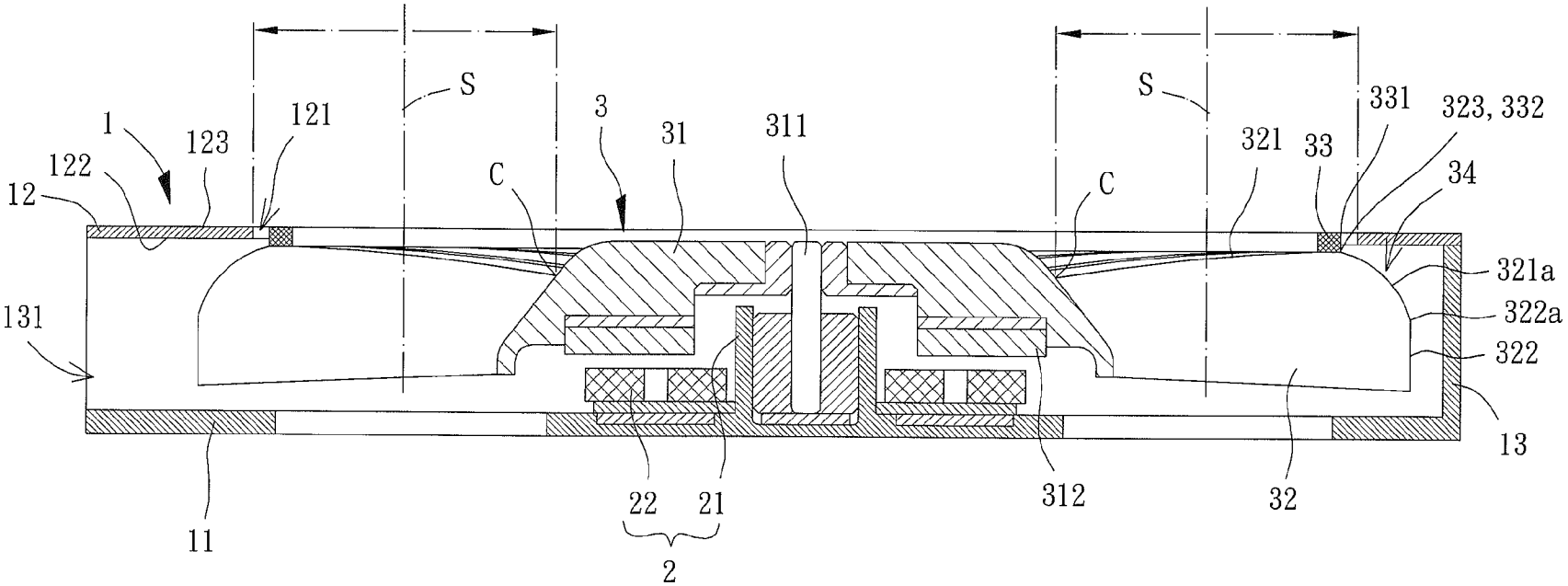
FIG. 4*a* is a cross-sectional view of the centrifugal fan shown in FIG. 3.

Cover plate portion 12 of fan frame 1 has an inner edge forming an air inlet 121. As shown in FIG. 4*a*, cover plate portion 12 further includes a first face 122 facing an interior of fan frame 1 (i.e. facing base plate portion 11), as well as a second face 123 facing away from the interior of fan frame 1. Lateral wall portion 13 includes an air outlet 131. In this arrangement, a fan frame structure of a centrifugal fan is formed. Based on different requirements, fan frame 1 may include more than one air inlet 121 and air outlet 131, and their locations can be changed as desired. For example, another air outlet may be arranged on base plate portion 11. Alternatively, lateral wall portion 13 may include a plurality of air outlets.

Stator assembly 2 is disposed between base plate portion 11 and cover plate portion 12 in fan frame 1. Stator assembly 2 can be of any structure capable of driving impeller 3 to rotate when coupled with impeller 3. Referring to FIG. 3, stator assembly 2 includes a shaft seat 21 and a coil unit 22. Shaft seat 21 can be affixed to or integrally formed on base plate portion 11 of fan frame 1. Coil unit 22 surrounds shaft seat 21 and is electrically connected to a driving circuit (not shown), driving impeller 3 to rotate. Coil unit 22 may include components such as a plurality of silicon steel plates, a coil, an insulation bobbin, etc. Alternatively, coil unit 22 may form at least one coil layer on a circuit board by layout, electroforming, etc.

Impeller 3 is rotatably coupled with stator assembly 2. In this embodiment, impeller 3 is rotatably coupled with shaft seat 21 of stator assembly 2. Preferably, impeller 3 is completely installed in fan frame 1. Impeller 3 includes a rotating member 31, a plurality of blades 32 and a connection ring 33.

Rotating member 31 may be of any device that can be rotatably coupled with stator assembly 2 and the plurality of blades 32, such as a plastic impeller or a metal base plate. In this embodiment, rotating member 31 has a shaft 311 and a permanent magnet 312. Shaft 311 is rotatably coupled with stator assembly 2. Preferably, shaft 311 is rotatably coupled with shaft seat 21 of stator assembly 2. Permanent magnet 312 is coupled with an inner face of rotating member 31 and is spaced from stator assembly 2 by an air gap.

The plurality of blades 32 may be affixed to or integrally formed on rotating member 31. In this embodiment, the plurality of blades 32 is integrally formed on an outer periphery of rotating member 31. Each blade 32 has a windward edge 321 and a lateral edge 322. Windward edge 321 faces air inlet 121, and lateral edge 322 faces an inner wall of fan frame 1 (namely, faces lateral wall portion 13 of fan frame 1).

Connection ring 33 of impeller 3 is coupled with windward edges 321 of the plurality of blades 32. Specifically, connection ring 33 of impeller 3 may be affixed to or integrally formed on windward edges 321 of the plurality of blades 32. Connection ring 33 may have cross sections in the form of a geometric shape, such as a rectangular shape, a round shape, an oval shape, a polygonal shape, etc. In this embodiment, connection ring 33 has cross sections in the form of a rectangular shape. When connection ring 33 has cross sections in the form of a round shape or an oval shape, connection ring 33 is able to better guide air into the fan.

Figure 4B:
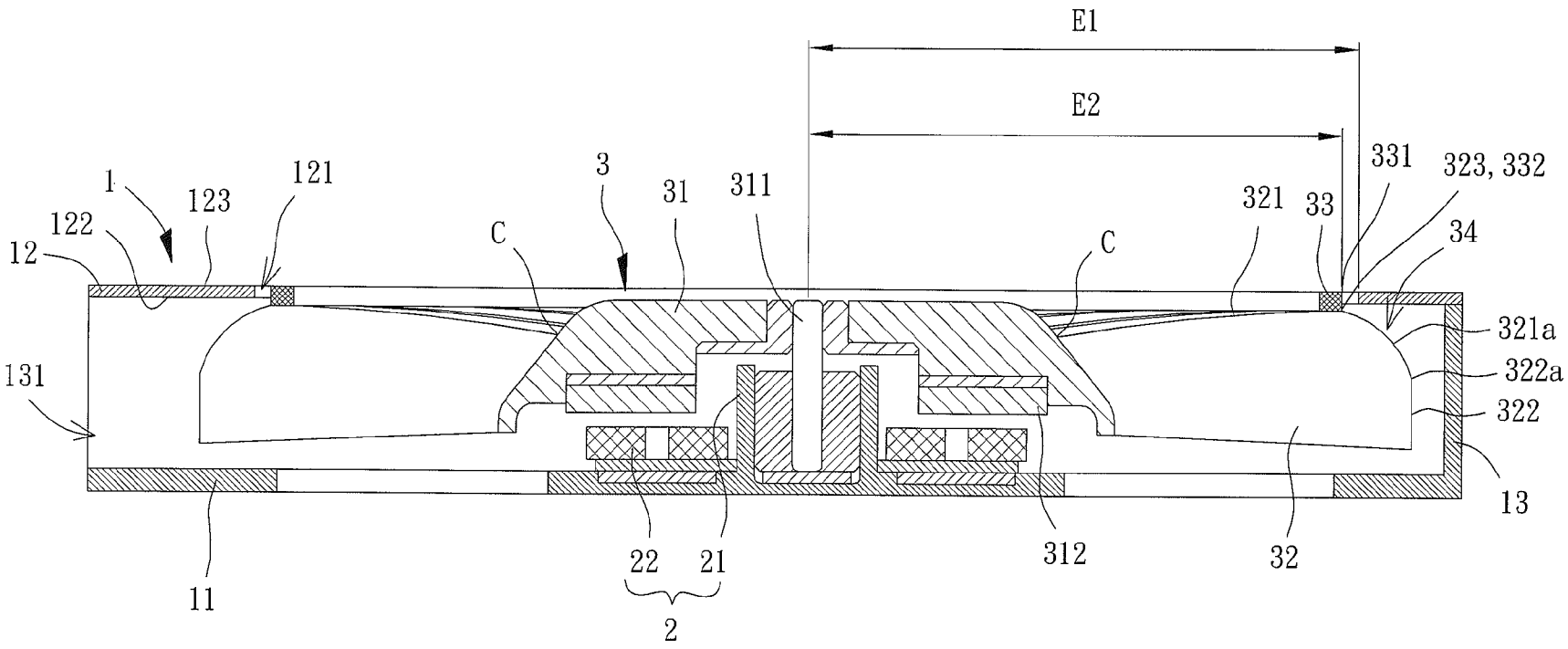
FIG. 4*b* is another cross-sectional view of the centrifugal fan shown in FIG. 3.

Based on the disclosed structure of impeller 3 shown in FIG. 4*a*, connection ring 33 may be located within a radial extent of air inlet 121. For example, referring to FIG. 4*b*, air inlet 121 has a radial extent E1 from a center of impeller 3, connection ring 33 has a radial extent E2 from the center of impeller 3. Second radial extent E2 is smaller than first radial extent E1. Furthermore, the part of the outer periphery of rotating member 31 that is coupled with windward edge 321 of each blade 32 is defined as a connecting edge C. Connecting edges C are spaced from the inner edge of cover plate portion 12 by a radial range. An axial reference plane S is arranged at a center of the radial range. Connection ring 33 is preferably located between axial reference plane S and the inner edge of cover plate portion 12. In this arrangement, connection ring 33 may be coupled with each blade 32 at a location adjacent to lateral edge 322 of the blade 32, enhancing the coupling effect between connection ring 33 and blades 32.

Windward edge 321 has a first coupling edge 323 and connection ring 33 has a second coupling edge 323. Windward edge 321 of blade 32 starts to extend downwards in a curved manner after the first coupling edge 323 until lateral edge 322 is met, thereby forming a truncating portion 34. In this arrangement, lateral edge 322 of each blade 32 has an end 322*a* connected to the truncating portion 34. End 322*a* is relatively distant to a bottom face of cover plate portion 12 among the part of blade 32 between the first coupling edge 323 and end 322*a*. Therefore, when the connection ring 33 is located within the radial extent of air inlet 121, windward edges 321 of blades 32 can be kept from the bottom face of cover plate portion 12 due to the arrangement of the truncating portion 34. Lateral edge 322 is more distant to the bottom face of cover plate portion 12 than windward edge 321 is to the bottom face of cover plate portion 12. Thus, windward edge 321 and lateral edge 322 can be kept from the bottom face of cover plate portion 12 at proper distances, preventing blades 32 from making contact with fan frame 1 during the rotation of impeller 3. Furthermore, since windward edge 321 is kept from the bottom face of cover plate portion 12 at a proper distance, wind noise can be reduced when impeller 3 guides air into the fan via air inlet 121, improving the operation of the fan. In addition, assume base plate portion 11 has an air inlet, the truncating portion 34 may also be arranged in a corresponding location on a bottom edge of each blade 32.

Based on the disclosed technique concepts above, the truncating portion 34 may have different implementations, as described below. Referring to FIG. 4*a*, windward edge 321 of blade 32 has an arcuate section 321*a* connected to lateral edge 322. Arcuate section 321*a* starts to extend downwards in an arcuate manner after the first coupling edge 323 of windward edge 321 until lateral edge 322 is met, thereby forming the truncating portion 34 between lateral edge 322 and connection ring 33.

Figure 5:
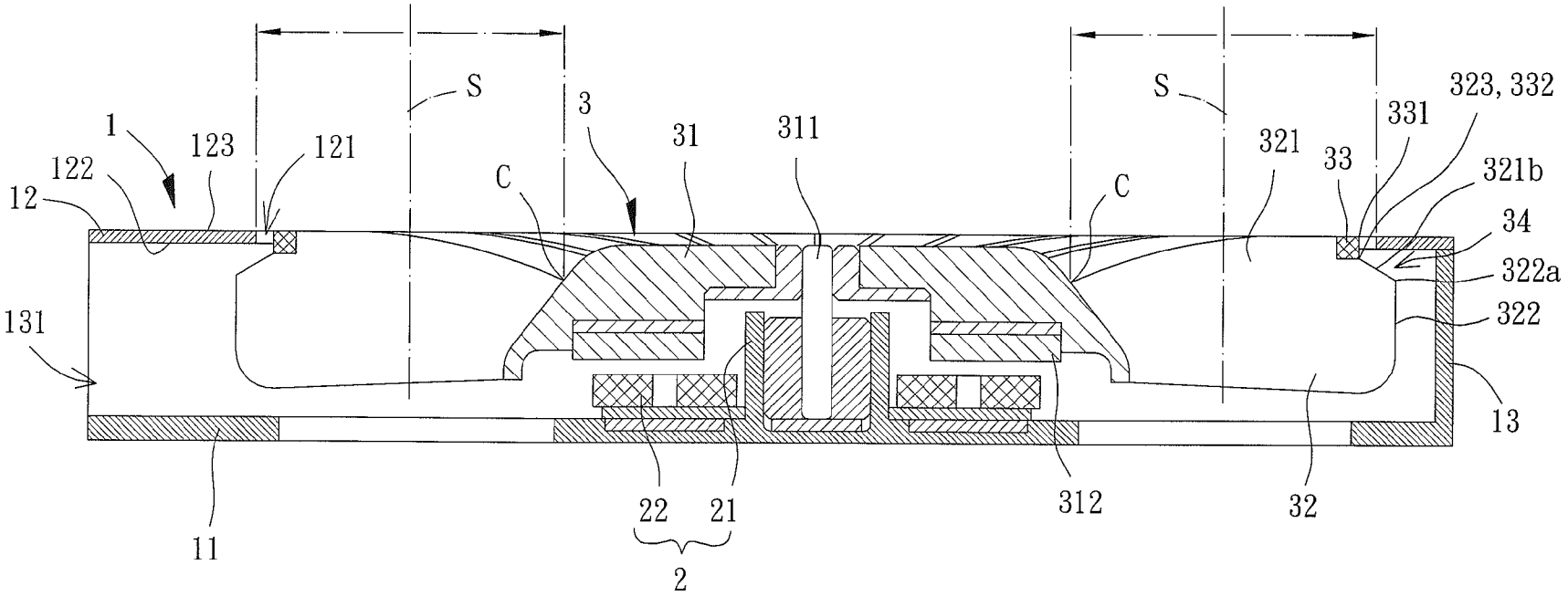
FIG. 5 is a cross-sectional view of a centrifugal fan according to a second embodiment of the invention.

Referring to FIG. 5, connection ring 33 has a top edge 331 and a bottom edge 332. First and second coupling edges 323 of windward edge 321 and connection ring 33 are located on bottom edge 332. Windward edge 321 of blade 32 has an inclined section 321*b* connected to lateral edge 322. Inclined section 321*b* starts to extend downwards in an inclined manner after the first and second coupling edges 323 until lateral edge 322 is met, thereby forming the truncating portion 34 between lateral edge 322 and connection ring 33. Blades 32 are preferably coupled with an inner periphery of connection ring 33 to enhance the coupling effect between blades 32 and connection ring 33.

Figure 6:
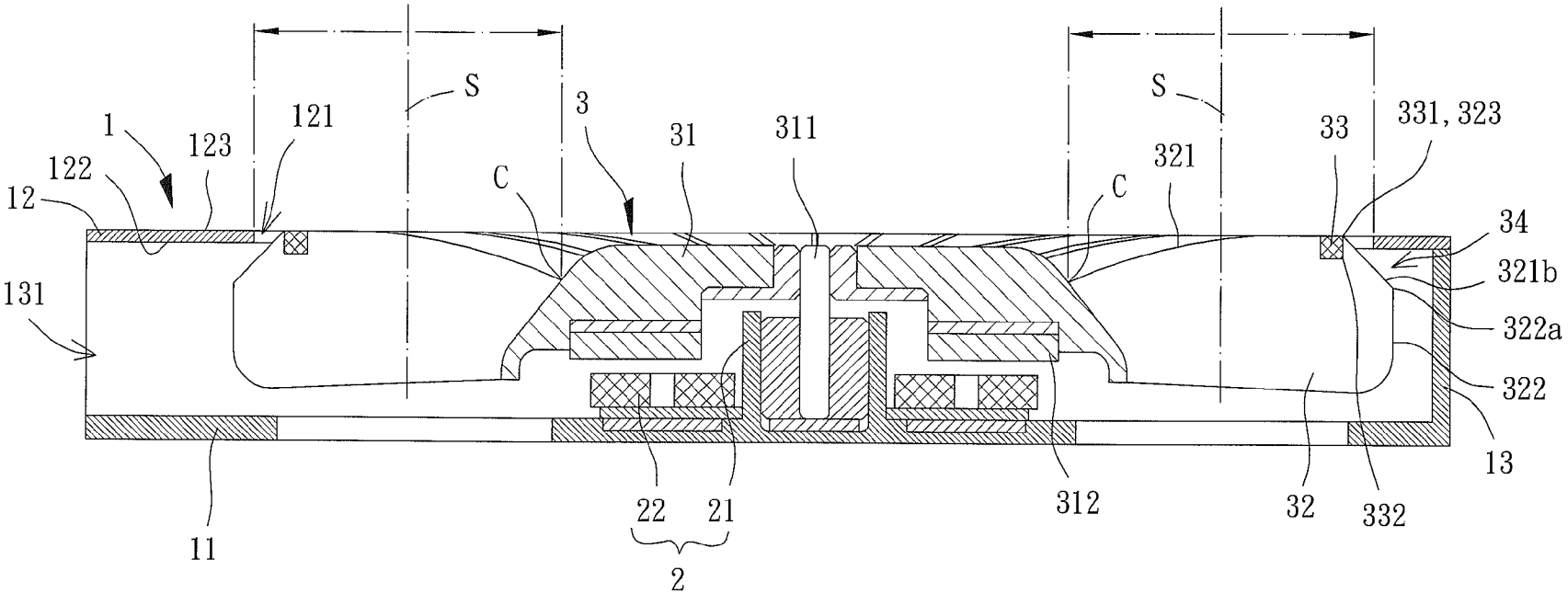
FIG. 6 is a cross-sectional view of a centrifugal an according to a third embodiment of the invention.

Referring to FIG. 6, connection ring 33 has a top edge 331 and a bottom edge 332. First and second coupling edges 323 of windward edge 321 and connection ring 33 are located on top edge 331. Windward edge 321 of blade 32 has an inclined section 321*b* connected to lateral edge 322 (inclined section 321*b* also encompasses arcuate section 321*a* shown in FIG. 4*a*). Inclined section 321*b* starts to extend downwards in an inclined manner after the first and second coupling edges 323 until lateral edge 322 is met, thereby forming the truncating portion 34 between lateral edge 322 and connection ring 33. Blades 32 preferably extend upon and around connection ring 33 in a manner that blades 32 are coupled with inner and outer peripheries of connection ring 33 to further enhance the coupling effect between blades 32 and connection ring 33.

Figure 7:
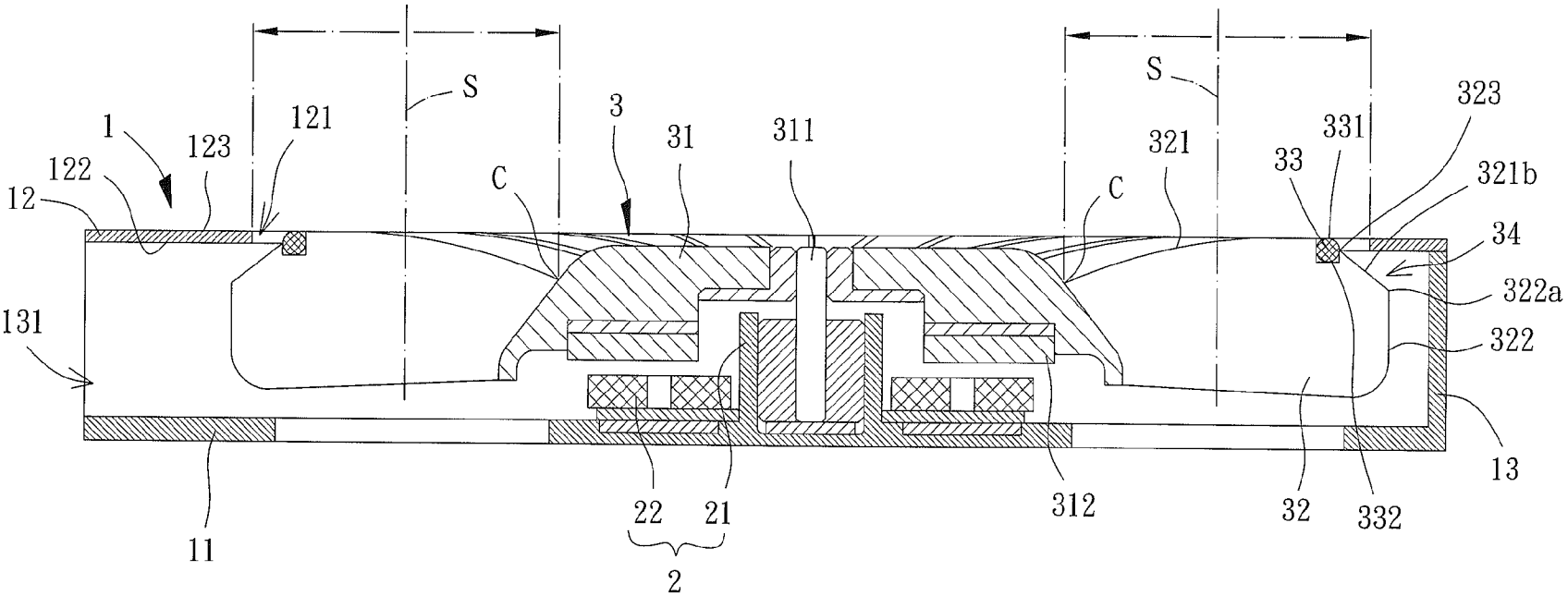
FIG. 7 is a cross-sectional view of a centrifugal fan according to a fourth embodiment of the invention.

Referring to FIG. 7, connection ring 33 has a top edge 331 and a bottom edge 332. First and second coupling edges 323 of windward edge 321 and connection ring 33 are located between top edge 331 and bottom edge 332. Windward edge 321 of blade 32 has an inclined section 321*b* connected to lateral edge 322 (inclined section 321*b* also encompasses arcuate section 321*a* shown in FIG. 4*a*). Inclined section 321*b* starts to extend downwards in an inclined manner after the first and second coupling edges 323 until lateral edge 322 is met, thereby forming the truncating portion 34 between lateral edge 322 and connection ring 33.

Figure 8:
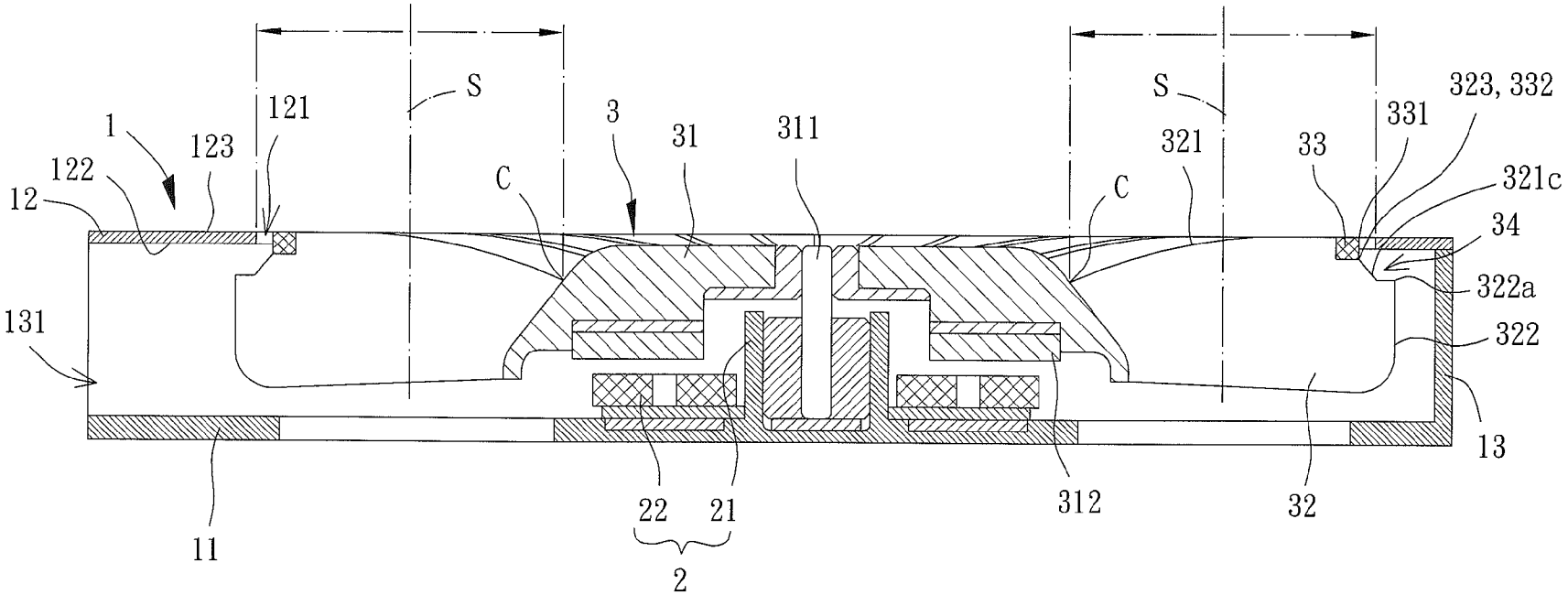
FIG. 8 is a cross-sectional view of a centrifugal fan according to a fifth embodiment of the invention.

Referring to FIG. 8, connection ring 33 has a top edge 331 and a bottom edge 332. First and second coupling edges 323 of windward edge 321 and connection ring 33 are located between top edge 331 and bottom edge 332. Windward edge 321 of blade 32 has a bending section 321*c* connected to lateral edge 322. Bending section 321*c* extends downwards in an inclined manner after the first and second coupling edges 323 and then extends radially to lateral edge 322, thereby forming the truncating portion 34 between lateral edge 322 and connection ring 33.

Based on the above various implementations of the centrifugal fan, stator assembly 2 is able to drive impeller 3 to rotate. In this manner, the centrifugal fan can be installed in an electronic device for cooling purposes. The principle on how stator assembly 2 drives impeller 3 to rotate, as well as the detailed structures of stator assembly 2 and impeller 3, are of conventional skills and therefore are not described herein again. In addition, although the centrifugal fan with an axial air gap is shown as a preferred example in FIGS. 2 to 8, the concept of the invention can also be applied to any centrifugal fan with a radial air gap, as it can be readily appreciated by one having ordinary skill in the art. Thus, the principle of the invention is applicable to any kind of centrifugal fan.

It can be recognized from the above description that, when connection ring 33 is located within the radial extent of air inlet 121, windward edge 321 of impeller 3 can be kept from the bottom face of cover plate portion 12 at a proper distance via the truncating portion 34 formed by arcuate section 321*a*, inclined section 321*b* and bending section 321*c*. This prevents blades 32 from making contact with fan frame 1 during the rotation of impeller 3. In addition, windward edges 321 of blades 32 are spaced from the bottom face of cover plate portion 12 at proper distances under the arrangement of the truncating portion 34, effectively reducing the wind noise generated when impeller 3 draws air into the fan. As such, the operation and cooling effect of the centrifugal fan can be improved. Moreover, since connection ring 33 is coupled with blades 32 of impeller 3, reinforced coupling between connection ring 33 and blades 32 is achieved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A centrifugal fan comprising:

a fan frame having a base plate portion, a cover plate portion, and a lateral wall portion arranged between the base plate portion and the cover plate portion, wherein the cover plate portion has an inner edge forming an air inlet, and wherein the lateral wall portion has an air outlet;

a stator assembly mounted in the fan frame; and an impeller mounted in the fan frame and comprising a rotating member, a plurality of blades and a connection ring, wherein the rotating member is rotatably coupled with the stator assembly, wherein the plurality of blades is arranged on an outer periphery of the rotating member, wherein each blade has a windward edge and a lateral edge, wherein the windward edge faces the air inlet, wherein the lateral edge faces the lateral wall portion, and wherein the connection ring is arranged on the windward edges of the plurality of blades;

wherein the windward edge of each blade has a first coupling edge, wherein the connection ring has a second coupling edge coupled to the first coupling edge, wherein the windward edge between the first coupling edge and the lateral edge extends downwards starting from the first coupling edge and away from the cover plate, thereby forming a truncating portion between the connection ring and the lateral edge.

2. The centrifugal fan as claimed in claim 1, wherein the air inlet has a first radial extent from a center of the impeller, wherein the connection ring has a second radial extent from the center of the impeller, and wherein the second radial extent is smaller than the first radial extent.

3. The centrifugal fan as claimed in claim 2, wherein a part of the outer periphery of the rotating member that is coupled with the windward edge of each blade is defined as a connecting edge, wherein the connecting edges are spaced from the inner edge of the cover plate portion by a radial range, wherein an axial reference plane is arranged at a center of the radial range, and wherein the connection ring is located between the axial reference plane and the inner edge of the cover plate portion.

4. The centrifugal fan as claimed in claim 1, wherein the connection ring has a top edge and a bottom edge, and wherein the first and second coupling edges are located on the top edge.

5. The centrifugal fan as claimed in claim 1, wherein the connection ring has a top edge and a bottom edge, and wherein the first and second coupling edges are located on the bottom edge.

6. The centrifugal fan as claimed in claim 1, wherein the connection ring has a top edge and a bottom edge, and wherein the first and second coupling edges are located between the top edge and the bottom edge.

7. The centrifugal fan as claimed in claim 1, wherein the windward edge of each blade between the first coupling edge and the lateral edge has an arcuate section connected to the lateral edge.

8. The centrifugal fan as claimed in claim 7, wherein the arcuate section extends downwards in an arcuate manner from the first coupling edge to the lateral edge, thereby forming the truncating portion.

9. The centrifugal fan as claimed in claim 1, wherein the windward edge of each blade between the first coupling edge and the lateral edge has an inclined section connected to the lateral edge.

10. The centrifugal fan as claimed in claim 9, wherein the inclined section extends downwards in an inclined manner from the first coupling edge to the lateral edge, thereby forming the truncating portion.

11. The centrifugal fan as claimed in claim 1, wherein the windward edge of each blade between the first coupling edge and the lateral edge has a bending section connected to the lateral edge.

12. The centrifugal fan as claimed in claim 11, wherein the bending section extends downwards in an inclined manner after the first coupling edge and then extends radially to the lateral edge, thereby forming the truncating portion.

13. The centrifugal fan as claimed in claim 1, wherein the plurality of blades is coupled with an inner periphery of the connection ring.

14. The centrifugal fan as claimed in claim 1, wherein the plurality of blades extends upon and around the connection ring in a manner that the plurality of blades is coupled with inner and outer peripheries of the connection ring.

15. The centrifugal fan as claimed in claim 1, wherein the lateral edge of each blade has an end connected to the truncating portion, and wherein the end is relatively distant to a bottom face of the cover plate portion among a part of the blade between the first coupling edge and the end.

16. The centrifugal fan as claimed in claim 1, wherein the connection ring has cross sections in the form of a round shape.

* * * * *